US007149146B2

(12) United States Patent
Kuijk et al.

(10) Patent No.: US 7,149,146 B2
(45) Date of Patent: Dec. 12, 2006

(54) DETERMINATION OF THE IMPEDANCE OF A MATERIAL BEHIND A CASING COMBINING TWO SETS OF ULTRASONIC MEASUREMENTS

(75) Inventors: Robert Van Kuijk, Clamart (FR); Jean-Luc Le Calvez, Clamart (FR); Benoit Froelich, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/303,362

(22) Filed: Dec. 15, 2005

(65) Prior Publication Data

US 2006/0133205 A1 Jun. 22, 2006

(51) Int. Cl.
*G01V 1/00* (2006.01)

(52) U.S. Cl. ..... 367/35; 181/105

(58) Field of Classification Search ..... 367/35, 367/25; 181/105

See application file for complete search history.

(56) References Cited

U.S. PATENT DOCUMENTS 2,538,114 A 1/1951 Mason
3,401,773 A 9/1968 Synnott, III
4,255,798 A 3/1981 Havira
4,703,427 A 10/1987 Catala et al.
6,018,496 A 1/2000 Stanke et al.
6,483,777 B1 * 11/2002 Zeroug ..... 367/35
6,850,462 B1 * 2/2005 McDaniel et al. ..... 367/35

* cited by examiner

*Primary Examiner*—Mark Hellner
(74) *Attorney, Agent, or Firm*—Victor H. Segura; Brigitte L. Echols

(57) ABSTRACT

The invention provides a method for estimating an impedance of a material behind a casing wall, wherein the casing is disposed in a borehole drilled in a geological formation, and wherein a borehole fluid is filling said casing, the material being disposed in an annulus between said casing and said geological formation, said method using a logging tool positionable inside the casing and said method comprising: exciting a first acoustic wave in said casing by insonifying said casing with a first pulse, the first acoustic wave having a first mode that may be one of flexural mode or extensional mode; receiving one or more echoes from said first acoustic wave, and producing a first signal; extracting from said first signal a first equation with two acoustic properties unknowns for respectively said material and said borehole fluid; exciting a second acoustic wave in said casing by insonifying said casing with a second pulse, the second acoustic wave having a thickness mode; receiving one or more echoes from said second acoustic wave, and producing a second signal; extracting from said second signal a second equation with said two acoustic properties unknowns; extracting the acoustic properties of said material behind the casing wall from said first and said second equations.

10 Claims, 5 Drawing Sheets

DETERMINATION OF THE IMPEDANCE OF A MATERIAL BEHIND A CASING COMBINING TWO SETS OF ULTRASONIC MEASUREMENTS

CROSS REFERENCE TO RELATED APPLICATIONS

This application claims priority to European patent application 04293062.8 filed Dec. 20, 2004.

FIELD OF THE INVENTION

This present invention relates generally to acoustical investigation of a borehole and to the determination of cement and mud impedances located in a borehole.

DESCRIPTION OF THE PRIOR ART

In a well completion, a string of casing or pipe is set in a wellbore and a fill material referred to as cement is forced into the annulus between the casing and the earth formation. After the cement has set in the annulus, it is common practice to use acoustic non-destructive testing methods to evaluate its integrity. This evaluation is of prime importance since the cement must guarantee zonal isolation between different formations in order to avoid flow of fluids from the formations (water, gas, oil) through the annulus.

Various cement evaluating techniques using acoustic energy have been used in prior art to investigate the quality of the cement with a tool located inside the casing.

A first cement evaluation technique, called thickness mode, shown in FIG. 1 is described in more details in U.S. Pat. No. 2,538,114 to Mason and U.S. Pat. No. 4,255,798 to Havira. The technique consists of investigating the quality of a cement bond between a casing 2 and an annulus 8 in a borehole 9 formed in a formation 10. The measurement is based on an ultrasonic pulse echo technique, whereby a single transducer 21 mounted on a logging tool 27 lowered in the borehole by a armored multi-conductor cable 3, insonifies with an acoustic waves 23 the casing 2 at near-normal incidence, and receives reflected echoes 24.

The acoustic wave 23 has a frequency selected to stimulate a selected radial segment of the casing 2 into a thickness resonance. A portion of the acoustic wave is transferred into the casing and reverberates between a first interface 11 and a second interface 14. The first interface 11 exists at the juncture of a borehole fluid or mud 20 and the casing 2. The second interface 14 is formed between the casing 2 and the annulus 8 behind the casing 2. A further portion of the acoustic wave is lost in the annulus 8 at each reflection at the second interface 14, resulting in a loss of energy for the acoustic wave. The acoustic wave losses more or less energy depending on the state of the matter 12 behind the casing 2.

Reflections at the first interface 11 and second interface 14, give rise to a reflected wave 24 that is transmitted to the transducer 21. A received signal corresponding to the reflected wave 24 has a decaying amplitude with time. This signal is processed to extract a measurement of the amplitude decay rate. From the amplitude decay rate, a value of the acoustic impedance of the matter behind the casing 2 is calculated. The value of the impedance of water is near 1,5 MRayl, whereas the value of impedance of cement is typically higher (for example this impedance is near 8 MRayl for a class G cement). If the calculated impedance is below a predefined threshold, it is considered that the matter is water or mud. And if the calculated impedance is above the predefined threshold, it is considered that the matter is cement, and that the quality of the bond between cement and casing is satisfactory.

This technique uses ultrasonic waves (200 to 600 kHz). The excited casing thickness mode involves vibrations of the segment of the casing confined to an azimuthal range, therefore the values of the impedance of the matter 12 behind the casing 2 may be plotted in a map as a function of a depth and an azimuthal angle, when characteristics of the mud and the casing are known. This technique provides information predominantly on the state of the matter located at the second interface 14. The impedance, as discussed above, is linked to state of the matter and therefore informed on quality of the cement.

Another cement evaluation technique, called flexural mode, is described in patent U.S. Pat. No. 6,483,777 to Zeroug. In FIG. 2, a logging tool 37 comprising an acoustic transducer for transmitting 31 and an acoustic transducer for receiving 32 mounted therein is lowered in a borehole by a armored multi-conductor cable 3. The transducer for transmitting 31 and the transducer for receiving 32 are aligned at an angle θ. The angle θ is measured with respect to the normal to the local interior wall of the casing N. The angle θ is larger than a shear wave critical angle of a first interface 11 between a casing 2 and a borehole fluid or mud 20 therein. Hence, the transducer for transmitting 31 excites a flexural wave A in the casing 2 by insonifying the casing 2 with an excitation aligned at the angle θ greater than the shear wave critical angle of the first interface 11.

The flexural wave A propagates inside the casing 2 and sheds energy to the mud 20 inside the casing 2 and to the fill-material 12 behind the casing 2. A portion B of the flexural wave propagates within an annulus 8 and may be reflected backward at a third interface 15. An echo 34 is recorded by the transducer for receiving 32, and a signal is produced at output of the echo 34. A measurement of the flexural wave attenuation may be extracted from this signal and the impedance of the cement behind the casing 2 is extracted from the flexural wave attenuation.

The values of the impedance of the matter 12 behind the casing 2 may be plotted in a map as a function of a depth and an azimuthal angle, when mud and casing characteristics are known. Since the portion B of the flexural wave propagates within the annulus 8, the corresponding signal provides information about the entire matter within the annulus 8, i.e., over an entire distance separating the casing 2 and the third interface 15.

Another cement evaluation technique, called extensional mode, is described in patent U.S. Pat. No. 3,401,773, to Synott, et al. FIG. 3 contains a schematic diagram of this cement evaluation technique involving acoustic waves having an extensional mode inside a casing 2. A logging tool 47, comprising longitudinally spaced sonic transducer for transmitting 41 and transducer for receiving 42, is lowered in a borehole by a armored multi-conductor cable 3. Both transducers operate in the frequency range between roughly 20 kHz and 50 kHz. A fill-material 12 isolates the casing 2 from a formation 10.

The sonic transducer for transmitting 41 insonifies the casing 2 with an acoustic wave 43 that propagates along the casing 2 as an extensional mode whose characteristics are determined primarily by the cylindrical geometry of the casing and its elastic wave properties. A refracted wave 44 is received by the transducer for receiving 42 and transformed into a received signal The received signal is processed to extract a portion of the signal affected by the presence or absence of cement 12 behind the casing 2. The extracted portion is then analyzed to provide a measurement of its energy, as an indication of the presence or absence of cement outside the casing 2. If a cement, which is solid is in contact with the casing 2, the amplitude of the acoustic wave 45 propagating as an extensional mode along the casing 2 is partially diminished; consequently, the energy of the extracted portion of the received signal is relatively small. On the contrary, if a mud, which is liquid is in contact with the casing 2, the amplitude of the acoustic wave 45 propagating as an extensional mode along the casing 2 is much less diminished; consequently, the energy of the extracted portion of the received signal is relatively high. The cement characteristics behind the casing 2 are thus evaluated from the value of the energy received. This technique provides useful information about the presence or absence of the cement next to the second interface 14 between the casing 2 and the annulus 8.

However, this cement evaluation technique uses low frequency sonic waves (20 to 50 kHz) and involves vibrations of the entire cylindrical structure of the casing 2. As a consequence, there is no azimuthal resolution. The characteristics of the matter 12 behind the casing 2 may be plotted in a curve as a function of depth only, when characteristics of the mud and the casing are known.

All those cement evaluation techniques need, prior to extracting impedance of the matter behind the casing, to know the characteristics of the borehole fluid or mud and the casing. Geometrical and physical properties of the casing should be known with sufficient precision, if we consider that the casing did not suffer of excessive corrosion or transformation during completion. The acoustic characteristics of mud (density and ultrasonic velocity) can be over or underestimated because they are subjected to pressure and temperature effects. It is an object of the invention to develop a method to determine the impedance of the matter behind the casing independently of the mud characteristics.

SUMMARY OF THE INVENTION

The invention provides a method for estimating an impedance of a material behind a casing wall, wherein the casing is disposed in a borehole drilled in a geological formation, and wherein a borehole fluid is filling said casing, the material being disposed in an annulus between said casing and said geological formation, said method using a logging tool positionable inside the casing and said method comprising:

- exciting a first acoustic wave in said casing by insonifying said casing with a first pulse, the first acoustic wave having a first mode that may be one of flexural mode or extensional mode;
- receiving one or more echoes from said first acoustic wave, and producing a first signal;
- extracting from said first signal a first equation with two unknowns, where first unknown is an acoustic property of said material and second unknown is an acoustic property of said borehole fluid;
- exciting a second acoustic wave in said casing by insonifying said casing with a second pulse, the second acoustic wave having a thickness mode;
- receiving one or more echoes from said second acoustic wave, and producing a second signal;
- extracting from said second signal a second equation with said two unknowns;
- extracting said acoustic property of said material from said first and said second equations.

Generally, the first unknown and the second unknown are acoustic properties taken in the list of: acoustic impedance, density, shear wave velocity or compressional wave velocity.

In a preferred embodiment, the first unknown is the impedance of said material and the second unknown is the impedance of said borehole fluid and the method further comprising, extracting said impedance of said borehole fluid from said first and said second equations.

In another preferred embodiment the first equation is a linear dependency between the impedance of said material and the impedance of said borehole fluid; and the second equation is also a linear dependency between the impedance of said material and the impedance of said borehole fluid. This simplification reduces the complexity and the time of processing.

The method here described is preferably done with a material as cement if the goal is to evaluate the integrity of cement completion. And to ensure an image of all of the borehole the method comprises guiding and rotating the logging tool inside the casing in order to evaluate the description of the material behind the casing within a range of depths and azimuthal angles. However, the method is still applicable if the material is different from cement.

BRIEF DESCRIPTION OF THE DRAWINGS

Further embodiments of the present invention can be understood with the appended drawings.

DETAILED DESCRIPTION

Figure 1:
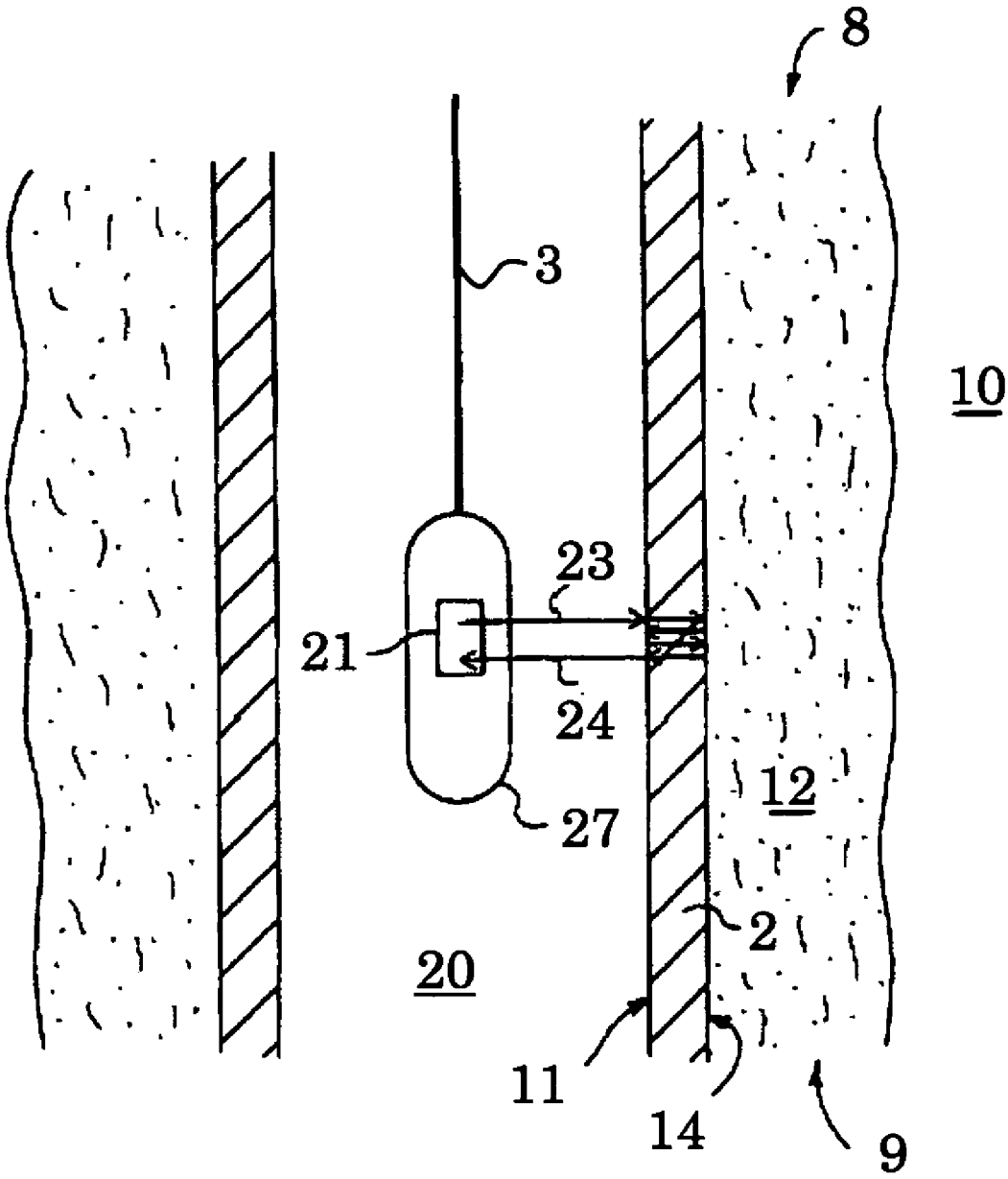
PRIOR ART Figure 1
FIG. 1 shows a schematic diagram of a cement evaluation technique using thickness mode from Prior Art.
Figure 2:
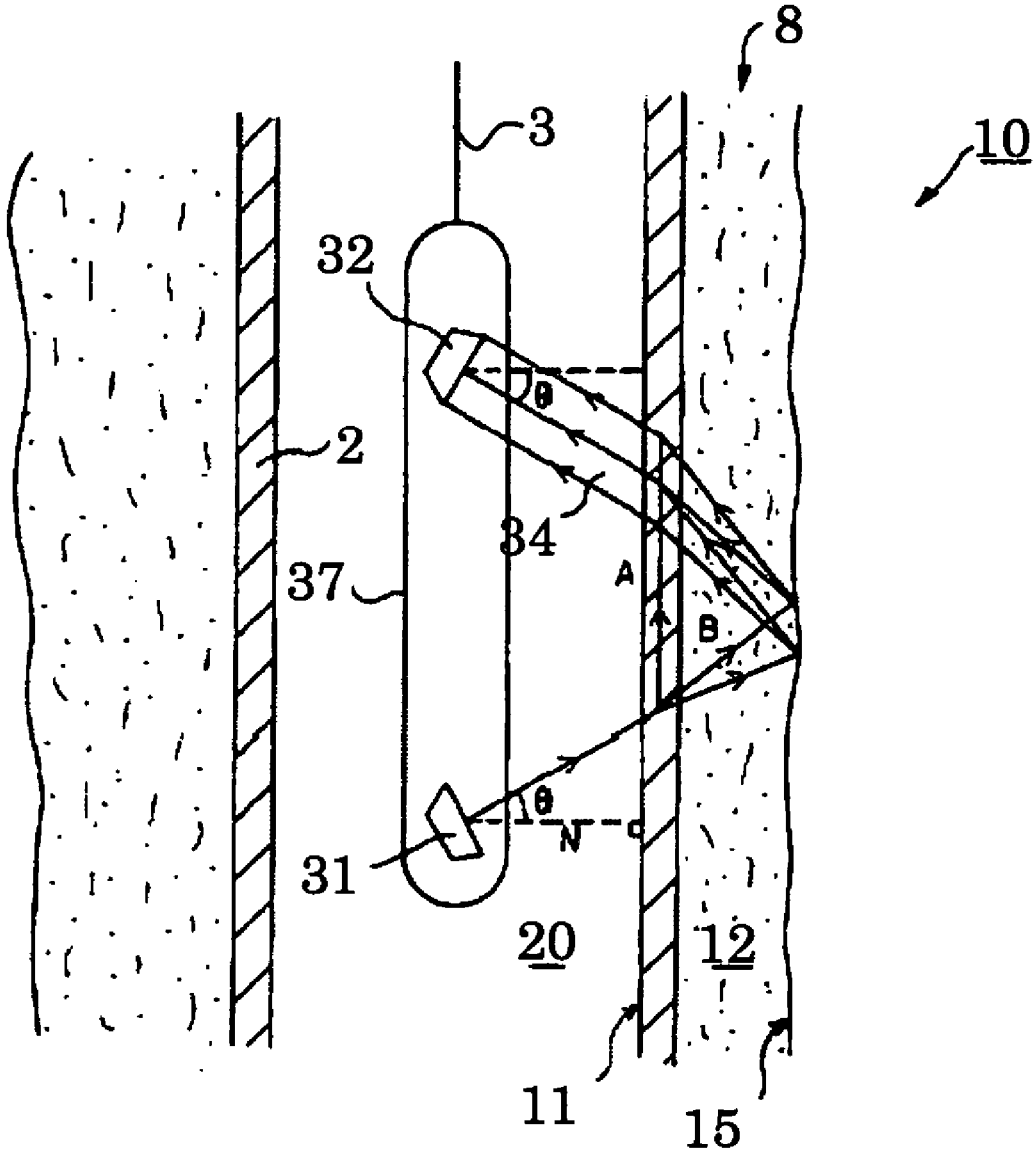
PRIOR ART Figure 2
FIG. 2 shows a schematic diagram of a cement evaluation technique using flexural mode from Prior Art.
Figure 3:
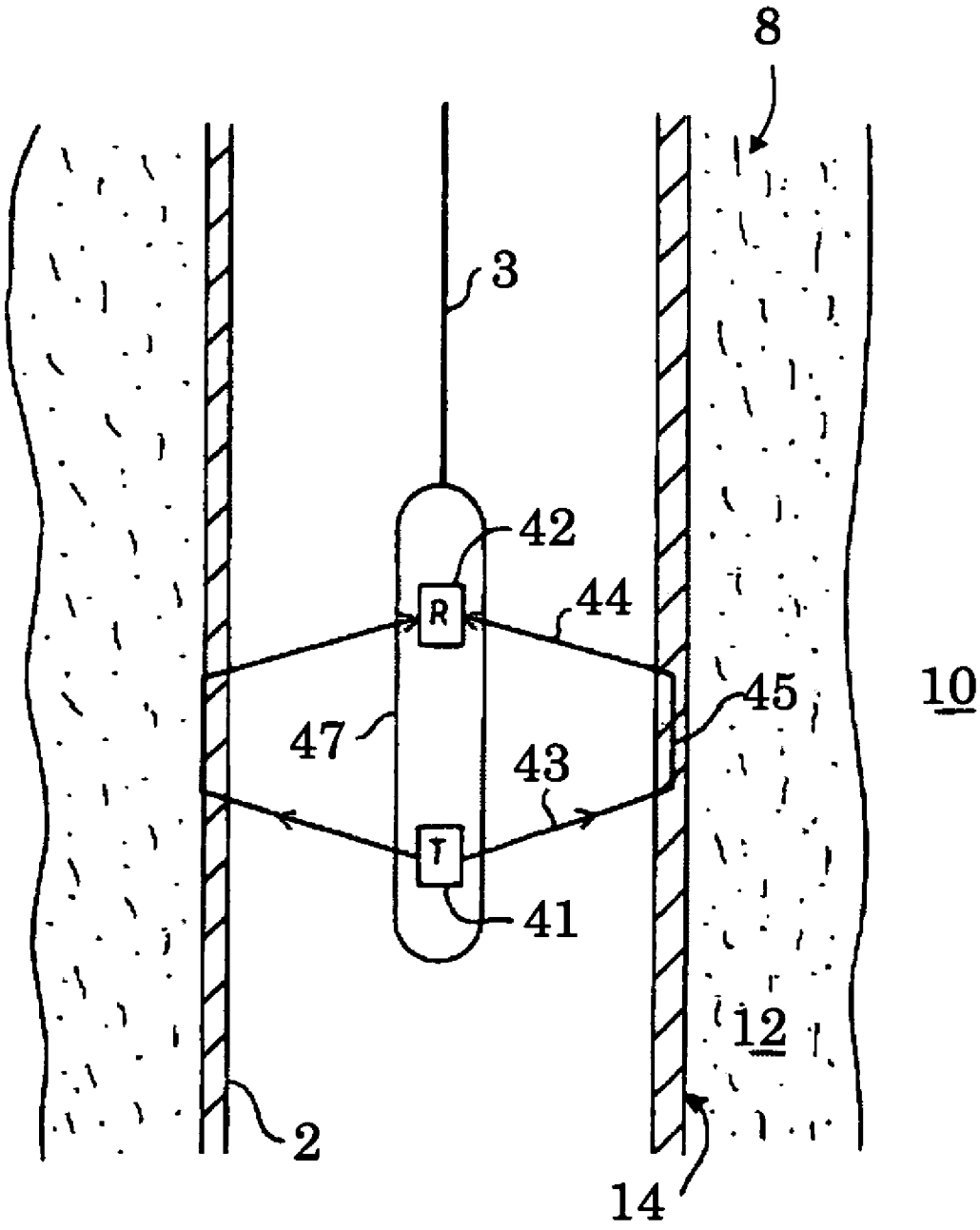
PRIOR ART Figure 3
FIG. 3 shows a schematic diagram of a third cement evaluation technique using extensional mode from Prior Art.
Figure 4:
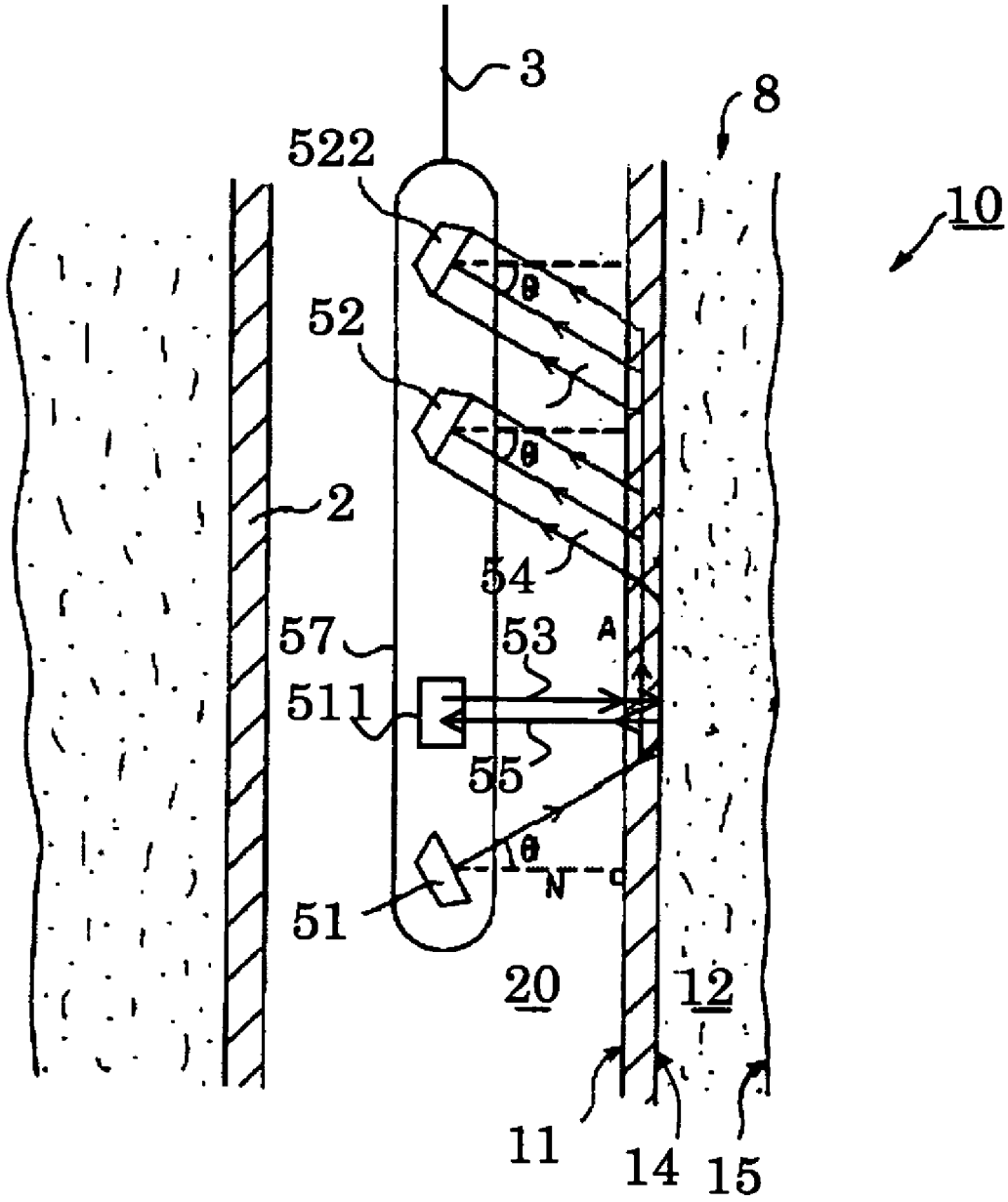
FIG. 4 shows a schematic diagram of the tool according to the invention in a first embodiment.

FIG. 4 is an illustration of the tool according to the present invention in a first embodiment. A description of a zone behind a casing 2 is evaluated by estimating a quality of a fill-material within an annulus between the casing 2 and a geological formation 10. A logging tool 57 is lowered by armored multi-conductor cable 3 inside the casing 2 of a well. The logging tool is raised by surface equipment not shown and the depth of the tool is measured by a depth gauge not shown, which measures cable displacement. In this way, the logging tool may be moved along a vertical axis inside the casing, and may be rotated around the vertical axis, thus providing an evaluation of the description of the zone behind the casing within a range of depths and azimuthal angle.

Typically, the quality of the fill-material depends on the state of the matter within the annulus. And different acoustic properties can inform on the state of the matter and therefore from the quality of the fill-material: acoustic impedance, density, shear wave velocity or compressional wave velocity.

In the embodiment here described, to evaluate the quality of cement and its integrity, the acoustic impedance of the matter within the annulus, which informs on the state of the matter (solid, liquid or gas), is measured. If the measured impedance is below 0.2 MRayls, the state is gas: it is considered that the fill-material behind the casing has voids, no cement is present. If the measured impedance is between 0.2 MRayls and 2 MRayls, the state is liquid: the matter is considered to be water or mud. And if the measured impedance is above 2 MRayls, the state is solid: the matter is considered to be cement, and the quality of the bond between cement and casing is satisfactory. Finally, the values of the impedance of the matter within the annulus are plotted in a map as a function of the depth and the azimuthal angle. In the continuation, the impedance of the matter within the annulus will be called the cement impedance ($Z_{cem}$), even if the matter within the annulus has not the composition of cement; and the borehole fluid impedance is the mud impedance ($Z_{mud}$).

The matter within the annulus may be any type of fill-material that ensures isolation between the casing and the earth formation and between the different types of layers of the earth formation. In the embodiment here described, the fill-material is cement, in other examples the fill material may be a granular or composite solid material activated chemically by encapsulated activators present in material or physically by additional logging tool present in the casing. In a further embodiment, the fill material may be a permeable material, the isolation between the different types of layers of the earth formation is no more ensured, but its integrity can still be evaluated.

The tool 57 comprises a first transducer for transmitting 51, which insonifies the casing 2 with a first acoustic wave. The first acoustic wave is emitted with an angle θ relative to a normal of the casing 2 greater than a shear wave critical angle of the first interface 11. Hence the first acoustic wave propagates within the casing 2 predominantly as a flexural mode. A portion of the energy of the first acoustic wave is transmitted to the annulus 8. A further portion of the energy is reflected inside the casing 2. A first transducer for receiving 52 and an additional transducer for receiving 522 respectively receive a first echo and respectively produce a first signal and an additional signal corresponding to the first acoustic wave. The first transducer for receiving 52 and the additional transducer for receiving 522 may be located on a vertical axis on the logging tool 57.

The first signal and the additional signal are recorded and analyzed by processing means, not shown. A measurement of an additional amplitude is extracted from the additional signal, and a measurement of a first amplitude is extracted from the first signal. A value of a flexural wave attenuation of the first acoustic wave along the casing 2 is calculated from the measurement of the additional amplitude and the measurement of the first amplitude. It has been noted that when the cement velocity is lower than a threshold value preferably about 2600 m/s for typical cement there is an approximate linear relation between the flexural wave attenuation and the sum of cement impedance and mud impedance. As the acoustic impedance is equal to the product of density by velocity, the condition on cement velocity can be interpreted, for typical cement (1 to 2 g/cm$^3$) as a condition on the cement impedance lower than about 2.6 to 5.2 MRayls. The approximate linear relation is given by:

$$Att=k_1\cdot(Z_{cem}+Z_{mud}) \quad (1)$$

The term $Z_{cem}$ is the true cement impedance, the term $Z_{mud}$ is the true mud impedance, Att is the flexural attenuation and the coefficient $k_1$ is the proportionality factor. The first equation (1) links the true cement impedance and the true mud impedance, which refer to the two unknown variables.

The tool 57 further comprises a second transducer for transmitting 511, which insonifies the casing 2 with a second acoustic wave 53. The second transducer for transmitting 511 is also used as a second transducer for receiving 511 and is substantially directed to a normal of the casing 2. The second acoustic wave 53 has a frequency selected to stimulate a selected radial segment of the casing 2 into a thickness resonance. The second acoustic wave has a thickness mode. The second transducer for receiving 511 receives one or more echoes 55 corresponding to the second acoustic wave 53 and produces a second signal corresponding to the second acoustic wave 53.

The second signal is recorded and analyzed by processing means, not shown. Processing means extract the resonance group delay width a, and this group delay width can be approximated by a linear second relation:

$$\alpha=k_2\cdot Z_{cem}+k_3\cdot Z_{mud} \quad (2)$$

The term $Z_{cem}$ is the true cement impedance, the term $Z_{mud}$ is the true mud impedance and $k_2$, $k_3$ are known proportionality factors. These factors are of different sign and magnitude, with $k_3$ being negative. The second equation (2) links the true cement impedance and the true mud impedance, which refer to the two unknown variables.

The proportionality factors $k_2$, $k_3$ are of different sign and therefore the system of equations (1) and (2) is non-singular and always yields a unique solution. Processing means combine first and second equations (1) and (2) and values of the true cement impedance (3) and of the true mud impedance (4) are extracted:

$$Z_{cem}=\frac{\alpha-\frac{k_3}{k_1}\cdot Att}{k_2-k_3} \quad (3)$$

$$Z_{mud}=\frac{\frac{k_2}{k_1}\cdot Att-\alpha}{k_2-k_3} \quad (4)$$

Finally, the values of the impedance of the matter within the annulus, in this case the cement impedance are plotted in a map as a function of the depth and the azimuthal angle. The cement quality in the annulus is therefore evaluated.

In a further embodiment, processing means may consider that the mud impedance is further constrained to only change slowly with depth in order to reflect the fact that the mud properties are only affected by pressure and temperature. In another further embodiment, processing means may consider that the mud impedance may also change rapidly for example at the interface between two segregated muds with different densities. For example, a Kalman filter may be used to define $Z_{mud}$ at depth z depending on $Z_{mud}$ at depth z−1; processing means will combine first and second equations (1) and (2) and values of the true cement impedance and of the true mud impedance will be extracted in the same way but with a condition on the variation of $Z_{mud}$ from depth z−1 to z.

In another further embodiment, when the linear approximations are not valid anymore, processing means use two equations: respectively a first equation (5) from the first and additional signals for a flexural mode and a second equation (6) from the second signal for a thickness mode:

$$Att=F(Z_{cem},Z_{mud}) \quad (5)$$

$$\alpha=G(Z_{cem},Z_{mud}) \quad (6)$$

For cement velocity lower than the threshold value, it has been noted that the system of two equations has still a unique couple of solution. And the system may be solved by a minimization process between the measured values of the flexural attenuation Att and of the group delay width α, and the expected values. And processing means combine first and second equations (5) and (6) and values of the true cement impedance (7) and of the true mud impedance (8) are extracted:

$$Z_{cem}=M(Att,\alpha) \quad (7)$$

$$Z_{mud}=N(Att,\alpha) \quad (8)$$

Figure 5:
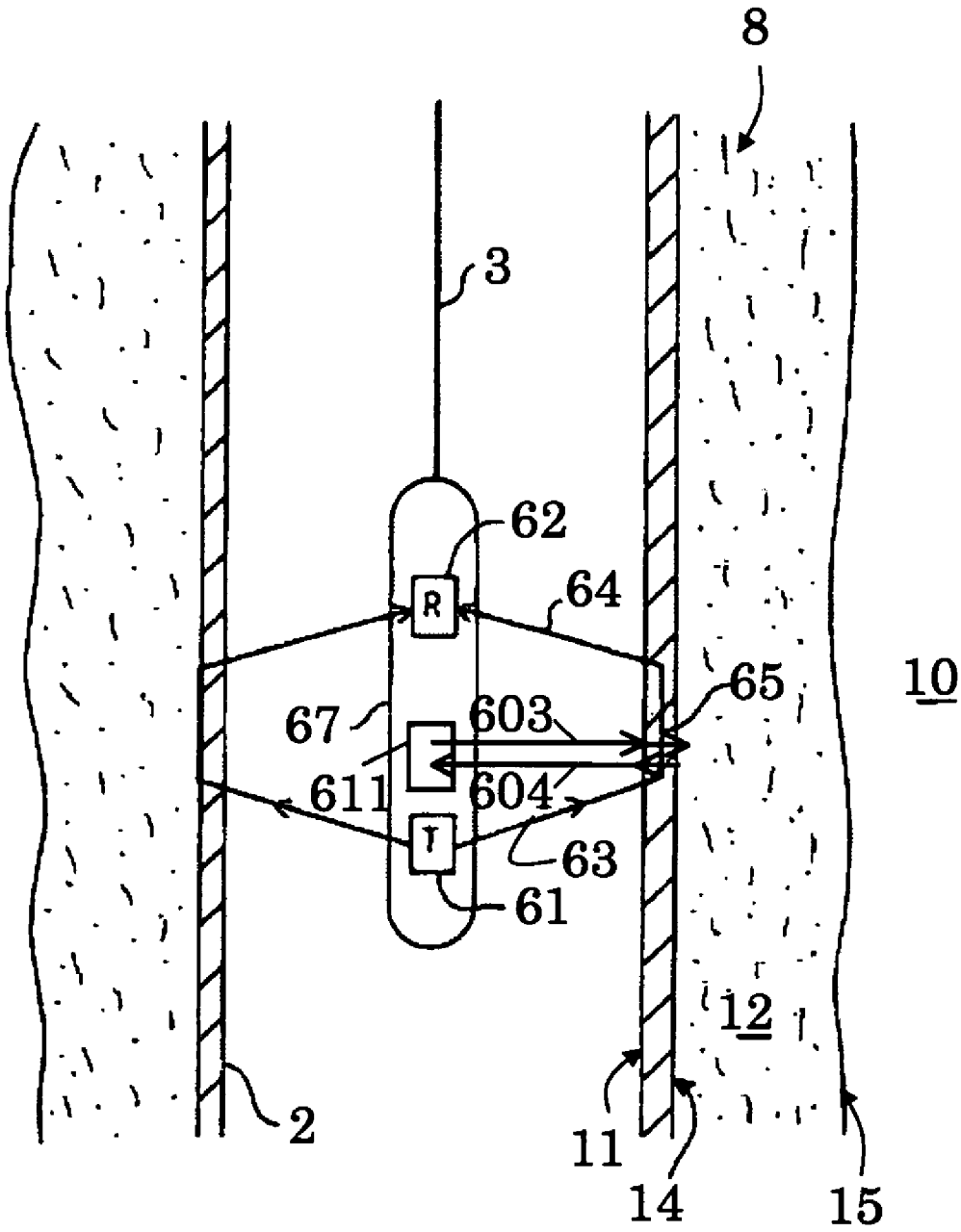
FIG. 5 shows a schematic diagram of the tool according to the invention in a second embodiment.

FIG. 5 is an illustration of the tool according to the present invention in a second embodiment. A description of a zone behind a casing 2 is evaluated by estimating a quality of a fill-material within an annulus between the casing 2 and a geological formation 10. A logging tool 67 is lowered by armored multi-conductor cable 3 inside the casing 2 of a well.

The tool 67 comprises a first transducer for transmitting 61, which insonifies the casing 2 with a first acoustic wave 63. The first acoustic wave propagates within the casing 2 predominantly as an extensional mode, whose characteristics are determined primarily by the cylindrical geometry of the casing and its elastic wave properties. A portion of the energy of the first acoustic wave 63 is transmitted to the annulus 8. A further portion of the energy is propagating as an acoustic wave 65 along the casing 2. The amounts of energy transmitted to the annulus 8 and propagated along the casing 2 depend on the state of the matter behind the casing 2. A refracted wave 64 is received by the transducer for receiving 62 and transformed into a first signal corresponding to the first acoustic wave 63.

The first signal is recorded and analyzed by processing means, not shown. The processing means extract a first equation corresponding to the first signal for the measured extensional attenuation $Att_{ext}$ with extensional mode:

$$Att_{ext}=F'(Z_{cem},Z_{mud}) \quad (9)$$

The first equation may be approximated by a linear equation dependent of $Z_{cem}$, the true cement impedance, and $Z_{mud}$, the true mud impedance.

The tool 67 further comprises a second transducer for transmitting 611, which insonifies the casing 2 with a second acoustic wave 603. The second transducer for transmitting 611 is also used as a second transducer for receiving 611 and is substantially directed to a normal of the casing 2. The second acoustic wave 603 has a frequency selected to stimulate a selected radial segment of the casing 2 into a thickness resonance. The second transducer for receiving 611 receives one or more echoes 604 corresponding to the second acoustic wave 603 and produces a second signal corresponding to the second acoustic wave 603.

The second signal is recorded and analyzed by processing means, not shown. The processing means extract a second equation corresponding to the second signal for the measured group delay width αwith thickness mode:

$$\alpha=G'(Z_{cem},Z_{mud}) \quad (10)$$

The second equation may be approximated to a linear equation dependent of $Z_{cem}$, the true cement impedance, and $Z_{mud}$, the true mud impedance: the second equation becomes in this way the equation (2) as already used above.

The extensional mode measurements and thickness mode measurements, because involving different waves not linked produce a system of two equations not collinear and therefore having one unique couple of solutions. If the system is not linear, the system may be solved by a minimization process between the measured values $Z_{flex}$ and $Z_{thick}$, and the expected values. And processing means combine first and second equations (9) and (10) and values of the true cement impedance (11) and of the true mud impedance (12) are extracted:

$$Z_{cem}=M'(Att_{ext},\alpha) \quad (11)$$

$$Z_{mud}=N'(Att_{ext},\alpha) \quad (12)$$

Finally, the values of the impedance of the matter within the annulus i.e. the cement impedance are plotted in a map as a function of the depth and the azimuthal angle. The cement quality in the annulus is therefore evaluated.

The invention claimed is:

1. A method for estimating an impedance of a material behind a casing wall, wherein the casing is disposed in a borehole drilled in a geological formation, and wherein a borehole fluid is filling said casing, the material being disposed in an annulus between said casing and said geological formation, said method using a logging tool positionable inside the casing and said method comprising:

(i) exciting a first acoustic wave in said casing by insonifying said casing with a first pulse, the first acoustic wave having a first mode that may be one of flexural mode or extensional mode;

(ii) receiving one or more echoes from said first acoustic wave, and producing a first signal;

(iii) extracting from said first signal a first equation with two unknowns, where first unknown is an acoustic property of said material and second unknown is an acoustic property of said borehole fluid;

(iv) exciting a second acoustic wave in said casing by insonifying said casing with a second pulse, the second acoustic wave having a thickness mode;

(v) receiving one or more echoes from said second acoustic wave, and producing a second signal;

(vi) extracting from said second signal a second equation with said two unknowns;

(vii) extracting said acoustic property of said material from said first and said second equations.

2. The method of claim 1, wherein the first unknown and the second unknown are acoustic properties taken in the list of: acoustic impedance, density, shear wave velocity or compressional wave velocity.

3. The method of claim 1, wherein the first unknown is the impedance of said material and wherein the second unknown is the impedance of said borehole fluid and the method further comprising, extracting said impedance of said borehole fluid from said first and said second equations.

4. The method of claim 3, wherein said first equation is a linear dependency between the impedance of said material and the impedance of said borehole fluid.

5. The method of claim 3, wherein said second equation is a linear dependency between the impedance of said material and the impedance of said borehole fluid.

6. The method according to claim 1, wherein the material is cement.

7. The method according to claim 1, further comprising guiding and rotating the logging tool inside the casing in order to evaluate the description of the material behind the casing within a range of depths and azimuthal angles.

8. The method of claim 4, wherein said second equation is a linear dependency between the impedance of said material and the impedance of said borehole fluid.

9. The method according to claim 2, further comprising guiding and rotating the logging tool inside the casing in order to evaluate the description of the material behind the casing within a range of depths and azimuthal angles.

10. The method according to claim 3, further comprising guiding and rotating the logging tool inside the casing in order to evaluate the description of the material behind the casing within a range of depths and azimuthal angles.

* * * * *